US006115240A

United States Patent [19]

Kaneko

[11] Patent Number: 6,115,240

[45] Date of Patent: Sep. 5, 2000

[54] PERSONAL COMPUTER HOUSED DESK, A PERSONAL COMPUTER HOUSED DESK FORMING MEMBER AND A DESK FORMING MEMBER THEREFOR

[75] Inventor: Kazuteru Kaneko, Tokyo, Japan

[73] Assignee: Nippon Blower Co., Ltd., Tokyo, Japan

[21] Appl. No.: 09/094,819

[22] Filed: Jun. 15, 1998

[30] Foreign Application Priority Data

Jun. 17, 1997 [JP] Japan ..... 9-175151

[51] Int. Cl.[7] ..... A47B 81/00; A47B 97/00; H05K 5/00; H05K 7/00

[52] U.S. Cl. ..... 361/683; 361/683; 361/724; 312/223.3

[58] Field of Search ..... 312/223.3, 223.2, 312/223.1, 194, 195; 361/683, 724

[56] References Cited

U.S. PATENT DOCUMENTS 5,763,985 6/1998 Asinovsky ..... 312/223.3
5,909,934 6/1999 McGraw ..... 312/223.3
5,971,504 10/1999 Kelley et al. ..... 312/195
6,022,087 2/2000 Gilbert ..... 312/194

*Primary Examiner*—Leo P. Picard
*Assistant Examiner*—Tung Minh Bui
*Attorney, Agent, or Firm*—Pearne & Gordon LLP

[57] ABSTRACT

A personal computer housed desk comprising a desk body including a plurality of desk forming members such as a top panel, a back plate panel, a leg or a side plate panel and a personal computer body comprising personal computer function units including at least a central processing unit and a random access memory to perform an arithmetic and logic operation and a cabinet containing the personal computer function units and at least one the desk forming members having a cavity or hollow space serving as the cabinet for the personal computer body whereby at least one of the personal computer function units is housed within the cavity in the desk forming member.

27 Claims, 12 Drawing Sheets

PERSONAL COMPUTER HOUSED DESK, A PERSONAL COMPUTER HOUSED DESK FORMING MEMBER AND A DESK FORMING MEMBER THEREFOR

TECHNICAL FIELD OF THE INVENTION

This invention pertains to a personal computer housed desk and more particularly to a desk serving as a personal computer body while maintaining the original function and appearance of the desk and also to a desk forming member adapted to be used for such a personal computer housed desk with or without the personal computer body housed.

BACKGROUND OF THE INVENTION

In general, a personal computer comprises a personal computer body serving to perform an arithmetic and logic operation which is operated by an input device such as a key board and/or a mouse. A peripheral equipment including an output unit such as a display and/or a printer is connected to the personal computer body in order that the personal computer body operatively handles informations in a predetermined manner. As shown in FIG. 13, in a prior art, such a personal computer and more particularly a personal computer body 14 functioning to perform an arithmetic and logic operation as a computer has been commercially available in the form of a single equipment and has been used while placed on a desk 10 or aside thereof.

Thus, the prior personal computer requires an exclusive space in which the personal computer is placed or contained. As a result, it reduces an operation space on the desk, the containing space in the desk or the space in the office, which disadvantageously causes the space effectiveness to be reduced. As the personal computer rapidly and widely prevails, there are various problems on a housing space for the personal computer in families as well as in business offices.

There has been used a compacted and portable personal computer such as a laptop or note personal computer which is different from the desktop or tower personal computer as shown in FIG. 13. However, even such a space-saving personal computer requires a space for keeping and containing it.

Various proposals have been made in view of the problems of space saving for the personal computer and/or the peripheral equipment or equipments, but most of them relates to desks adapted to contain them as they are.

For instance, there have been proposed desks comprising a lifting top plate panel on which various equipments such as a large-sized display (a CRT), a key board and a printer are placed so that the equipment can be exposed on the desk by the top plate panel moving up when they should be used and so that they can be contained within the space below the top plate panel when they are not used (see Japan Patent Laying-Open No. 112/1994, Japan Utility Model Laying-Open No. 133619/1989, Japan Utility Model Laying-Open No. 93263/1993 and Japan Utility Model Publication No. 16506/1991).

However, with the equipment such as the display positioned within the lower space below the top plate panel of the desk, the space below the top plate panel of the desk cannot be used for introducing a chair into the lower space and even though the personal computer is not used, a person or operator cannot introduce its legs and foot into the lower space, which prevents the person from performing paper work or the like on the desk in a comfortable manner. If there is maintained a space enough for introducing the operator's foot thereinto, then the desk will be large-sized and therefore the space cannot be saved. Also, since the lifting top plate panel is required to have an area enough to place the display thereon, the top plate panel will damage the appearance of the desk and also the stationary top plate panel portion other than the lifting top plate panel portion will has a narrow area, which will be difficult for the operator to do the business operation other than the operation of the personal computer. Thus, the original function of the desk in which the display is contained will be disadvantageously reduced.

There has been proposed a desk having spaces intentionally formed in view of the design for containing various equipment of the personal computer (see Japan Utility Model Laying-Open No. 54126/1989). Various equipments such as a body of a CPU, a key board, a CRT display and a printer are contained in the intentionally formed spaces, respectively and covered by doors to close the spaces so that they disappear when they are not used. When the personal computer should be used, the doors are opened so that the equipments can be operated.

However, the computer housed desk has various disadvantages of the opened doors becoming obstacles when the personal computer should be used and a desk work other than an operation of the personal computer being impossible because the area of a top plate panel adapted to be used for the desk work will be reduced or lost. Thus, it will be noted that the prior computer housed desk will reduce the original function and the appearance of the desk.

Furthermore, it should be noted that both of the aforementioned two kinds of the computer housed desk has the large space below the top plate panel scarified for containing the equipments of the personal computer. This prevents desk forming members such as a side box or side boxes having a plurality of drawers included therein from being installed, which disadvantageously causes the original function of the desk such as containing stationery or the like to be damaged or lost. Thus, it will be noted that the prior computer housed desk is not properly used for the original function other the operation of the personal computer and cannot be accepted to the families which require a sense of decoration including a good appearance in view of the harmony with other furniture even though it will be accepted to offices generally requiring the function of the office work rather than the decoration or appearance.

There has been proposed a printer housed desk which comprises a printer contained in a drawer thereof (see Japan Patent Laying-Open No. 31514/1995). The printer housed desk. has a disadvantage of the printer containing drawer having no original function of containing various articles such as stationery, which prevents the desk from having its original function.

There has been proposed a printer housed desk which contains at least a printing section and a paper feeding section of the printer (see Japan Patent Laying-Open No. 212876/1992). Since the printer housed desk is one corresponds to the printer comprising a cabinet having legs added thereto, it generally has the same size as the conventional printer and requires a space for containing it. Thus, it will be noted that the printer housed desk cannot be expected to have a space fully saved and all it has is a particular function of a computer desk, but not that of a conventional desk. Also, it has a disadvantage of being not able to easily check, maintain and repair the parts thereof such as the printing section.

There has been also a desk in which a personal computer body, a display and an input unit such as a key board are totally contained (see Japan Utility Model Laying-Open No. 31829/1988). Such a computer housed desk contains the personal computer body formed by itself being contained in a particular cabinet, but not the unit or units forming the personal computer body. Thus, it will be noted that the side box or boxes of the desk are occupied by the personal computer body. It will be understood that such a computer housed desk can have no original function of a conventional desk and also has a disadvantage of being not able to check, maintain and repair the housed personal computer body as well as to expand its function.

Thus, it will be understood that all of the prior computer housed desk or peripheral equipment housed desk has no original function of a conventional desk such as doing desk work or containing stationery or the likes. Furthermore, it will be understood that an extension of function of the computer operation cannot be expected with any of the prior computer housed desks.

SUMMARY OF THE INVENTION

Accordingly, it is a principal object of the invention to provide a computer housed desk in which a personal computer body is contained for saving a space without damaging or losing an original function and a good appearance of the desk.

It is another object of the invention to provide a computer housed desk adapted to check, maintain and repair a personal computer body housed within the desk.

It is further object of the invention to provide a computer housed desk adapted to more easily expand functions of the housed personal computer body.

It is further object of the invention to provide a desk forming member for a computer housed desk in which a personal computer body is contained for saving a space without damaging or losing an original function and an appearance of the desk.

It is further object of the invention to provide a desk forming member for a computer housed desk in which a personal computer body is to be contained for saving a space without damaging or losing an original function and an appearance of the desk.

In accordance with a principle of the present invention, there is provided a personal computer housed desk comprising a desk body including a plurality of desk forming members, at least one of which serves as a cabinet for containing at least one of personal computer function units including at least a central processing unit and a random access memory to perform an arithmetic and logic operation.

In accordance with a first aspect of the present invention, there is provided a personal computer housed desk comprising a desk body including a plurality of desk forming members and a personal computer body comprising personal computer function units including at least a central processing unit (CPU referred to as hereinafter) and a random access memory (RAM referred to as hereinafter) to perform an arithmetic and logic operation and a cabinet containing said personal computer function units and at least one of said personal computer function units is housed within a cavity of at least one of said desk forming members whereby said at least one of said desk forming members serves as said cabinet for said personal computer body.

It should be noted that the cavity of the desk forming member is an empty inner hollow which is not normally never used for containing anything in a conventional manner. Typically, the cavity of the desk forming member may be formed by being defined by the top sheet and the side frames of the panel-like desk forming member or by being defined by two opposed sheets forming the panel-like desk forming member, but it will be understood that the cavity is not limited thereto.

With the desk forming member containing the personal computer function unit or units such as the CPU making practical operation and the RAM or other units among various equipment for the personal computer within the cavity of the desk forming member so that the latter serves as the cabinet for the personal computer body whereby the desk forming member forms a part of the personal computer, the desk forming member itself functions as the personal computer because the desk forming member supports and contains the personal computer function unit or units. This means that any space in a container or cabinet other than the desk will not be required for containing the personal computer body and allows the space to be saved.

With the desk forming member having the cavity utilized for containing the personal computer function unit or units, various parts of the personal computer function unit or units can be more effectively arranged and contained in a scattered manner in accordance with the configuration of the desk forming member. Thus, it will be noted that the containing spaces of the desk such as a side box or boxes having a plurality of drawers will not be sacrificed for the personal computer body, which it will be noted is different from the prior personal computer housed desk containing the personal computer body having a predetermined appearance as the ready-made unit. It will be noted that this can effectively use the top plate panel and/or the space or spaces of the desk and that this also neither reduces nor loses the original function of the desk and never makes the appearance of the desk worse. In other words, the personal computer housed desk can be referred to as a desk-type personal computer.

Thus, the aforementioned personal computer housed desk may be made so as to have a configuration as well as patterns and/or colors in view of the appearance in the same manner as the conventional desk having no personal computer contained. This allows the personal computer housed desk to have a decorative appearance insured in accordance with user's taste and also to be made in view of harmony with other furniture as an interior decoration as well as in view of its function. Thus, it will be noted the personal computer housed desk of the invention can be more easily accepted to families as well as to offices.

The word "personal computer function unit or units" is referred to as a part or parts directly involving an operative treatment which is an original function of the personal computer and/or electrical connecting or bonding thereof. Typically, it is referred to as a concept including at least a CPU and a RAM for making an arithmetic and logic operation, but it should be noted that it is not limited thereto and that it may include a power source, a hard disk drive including a hard disk or disks, a read only memory (ROM referred to as hereinafter), a mother board mounting fundamental parts of the personal computer such as the CPU, the ROM and the RAM and hooking up them to each other, an interface board, an expansion slot or slots, an outer memory drive such as a FD drive for driving a flexible disk or disks (FD referred to as hereinafter) or a read only memory (CD-ROM referred to as hereinafter) drive for driving a CD-ROM having a compact disk or disks used, a power source switch, a reset switch, a modulator-demodulator (MODEM referred to as hereinafter) or the likes.

In the first aspect of the invention, the desk forming member containing a part, parts or all of the personal computer function units may be a panel-like desk forming member and more particularly one or some of a top plate panel, a leg or legs, a side plate panel or panels for a side box or boxes and a back plate panel. Thus, it will be noted that a top portion including the top plate panel, a leg portion including the leg or legs, a side box portion including the side box panel or panels and a back portion including the back plate panel are formed of a part or cabinet of the personal computer body.

With the panel-like desk forming member such as the top plate panel serving as the cabinet for the personal computer function units, parts such as electronic parts of the personal computer function units having a relatively smaller thickness may be arranged or contained in an effective manner in the desk forming member or members in accordance with a configuration thereof. Thus, it will be noted that the personal computer housed desk having the personal computer function unit or units harmonized to the configuration of the desk can provide a space saving while the original function of the desk such as containing articles other than the personal computer function units and the appearance of the desk are maintained in the same manner as the conventional desk.

In the first aspect of the invention, the desk forming member containing one, some or all of the personal computer function units may be a top plate panel and the personal computer function unit or units are contained in the cavity of the top plate panel. If the top plate panel has a shallow drawer, the personal computer function unit or units may be disposed in the cavity of the top plate panel which is supposed to be at the position above the shallow drawer.

With the top plate panel having a relatively larger area serving as the cabinet for the personal computer function unit or units, they may be more easily arranged or contained in an effective manner in the top plate panel. With the top plate panel having the shallow drawer and with the personal computer function unit or units disposed in the cavity thereof in a manner faced to the shallow drawer, the personal computer function unit or units may be protected by the drawer from an external atmosphere such as dust or trash because of the drawer closing the cavity in which the personal computer function units are contained. The operator can have access to the personal computer function units within the top plate panel by sliding and removing the shallow drawer out of the top plate panel. This allows them to be checked, maintained or repaired and also to expand their function.

In the first aspect of the invention, the personal computer housed desk may comprise a memory drive for an external memory such as the CD-ROM and/or a FD and also a power source switch for the personal computer body provided on an accessible face such as a front face of the desk body so that they can be operated from the outside of the desk.

With the memory drive for the external memory provided on the front face of the desk body, it can be more easily operated from the outside of the desk. It should be noted that the memory drive and the power source switch hardly damage the original function and the appearance of the desk itself while the effectiveness of the operation of the personal computer is maintained. It will be understood that a reset switch may be provided on an accessible face such as a front face of the desk body so that it can be operated from the outside of the desk, if necessary.

In the first aspect of the invention, the desk body may have at least one expansion connection such as an expansion slot through which an external hard disk drive or memory drive is to be connected to the personal computer function units housed in the desk body. This allows the personal computer function units to be more easily expanded.

In the first aspect of the invention, the desk forming member containing one, some or all of the personal computer function units may have means to access to the personal computer function units which may be accomplished by the desk forming member being assembled so as to be able to be opened or removed, for example.

With the desk forming member being able to be opened or removed in this manner, the operator may be easily accessible to the personal computer function units in the desk so that they can be removed out of the desk body. This allows the personal computer function units to be easily checked, maintained, repaired or expanded in its function. It should be understood that such desk forming members as the legs or the back plate panel which are to be kept normally closed without coming in sight can protect the personal computer function units and allows them to be checked and maintained in a proper manner without damaging the appearance thereof. What means the phrase "so as to be accessible to the personal computer function unit or units" is to be able to expose the personal computer function unit or units which are normally contained and covered by the desk forming member or members so as to disappear, which enables the personal computer function unit or units to be checked, for example.

In the first aspect of the invention, the desk forming member containing the personal computer function unit or units may be removably assembled relative to the other desk forming members.

With the desk forming member serving as a part of the personal computer body removably assembled relative to the other desk forming member, the desk forming members can be conveyed in a disassembled manner without damaging the function of the personal computer body especially by taking full care of the desk forming member or members containing the personal computer function unit or units, which cannot be expected by conveying the whole desk as a unit without disassembling it.

Of late, the personal computer body rapidly get developed or expanded in its function and such a development or expansion of the function of the personal computer can be accomplished so as to have a higher grade by exchanging only the corresponding desk forming member for the new one having the personal computer function units or units of higher grade installed, but not by exchanging the whole desk.

In accordance with a second aspect of the invention, there is provided a personal computer housed desk forming member adapted to be used for the personal computer housed desk constructed in accordance with the first aspect of the invention and having a cavity provided therein, a personal computer body comprising personal computer function units including at least a CPU and a RAM to make an arithmetic and logic operative treatment and a cabinet for containing the personal computer function units, the desk forming member characterized by serving as the cabinet of the personal computer body with at least one of the personal computer function units contained in the cavity of the desk forming member.

In the second aspect of the invention, the desk forming member containing at least one of the personal computer function units may be one or some of a top plate panel, a leg or legs, a side plate panel or panels for a side box or boxes and a back plate panel.

In the second aspect of the invention, the desk forming member containing at least one of the personal computer function units may have means to access to the personal computer function units which may be accomplished by the desk forming member being assembled so as to be able to be opened or removed, for example.

With the desk forming member serving as the cabinet for the personal computer function units, the personal computer can easily have a higher grade by exchanging the desk forming member for the new one. Furthermore, the desk forming member such as the tope plate panel having no personal computer function units contained therein for a conventional desk may be exchanged for the desk forming member containing the personal computer function units so that the conventional desk becomes a personal computer housed desk.

In accordance with a third aspect of the invention, there is provided a desk forming member adapted to be used for the desk forming member containing at least one of the personal computer function units and having a cavity in which at least one of the personal computer function units is to be contained and a support member on which at least one of the personal computer function units is to be supported.

With the desk forming member having the cavity in which at least one of the personal computer function units is to be contained and the support member on which at least one of the personal computer function units is to be supported, the personal computer function unit or units may be contained if necessary so as to form the personal computer housed desk.

A user is expected to construct its favorite personal computer system by assembling various parts to each other instead of the ready made personal computer function units while expecting a space saving thereof.

BRIEF DESCRIPTION OF THE DRAWING

The above and other objects and features of the invention will be apparent from the description of the embodiments of the invention taken along with reference to the accompanying drawings in which.

DETAILED DESCRIPTION OF EXAMPLES OF THE INVENTION

Figure 1:
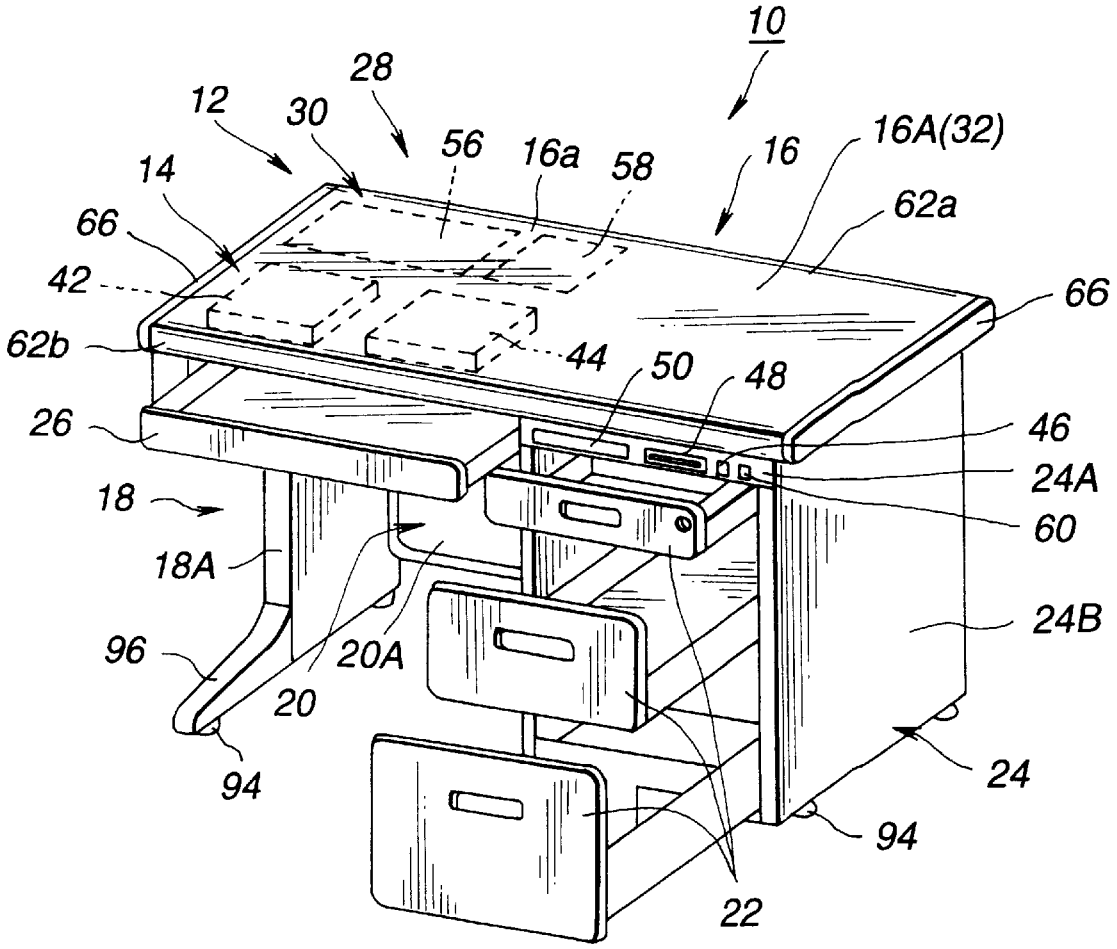
FIG. 1 is a perspective view of a personal computer housed desk constructed in accordance with one embodiment of the invention.

Now, one embodiment of a personal computer-housed desk will be described with reference to the drawings. FIG. 1 shows the personal computer housed desk 10 constructed in accordance with one embodiment of the invention. The personal computer housed desk 10 comprises a desk body 12 and a personal computer body 14.

As shown in FIG. 1, the desk boy 12 comprises a top plate member 16, a leg member 18, a back plate member 20 and a side box 24 having a plurality of drawers 22 provided therein. A shallow drawer 26 may be provided below the top plate member 16 so that it may be slidingly moved along a pair of rails not shown.

The top plate member 16 is formed of a top plate panel 16A, the leg member 16 is formed of a panel-like leg 18A, the back plate member 20 is formed of a back plate panel 20A and the side box 24 is formed of a side plate panel 24A. These panels 16A, 18A, 20A and 24A will be generally referred to as a desk forming member 28 herein just below.

Figure 2:
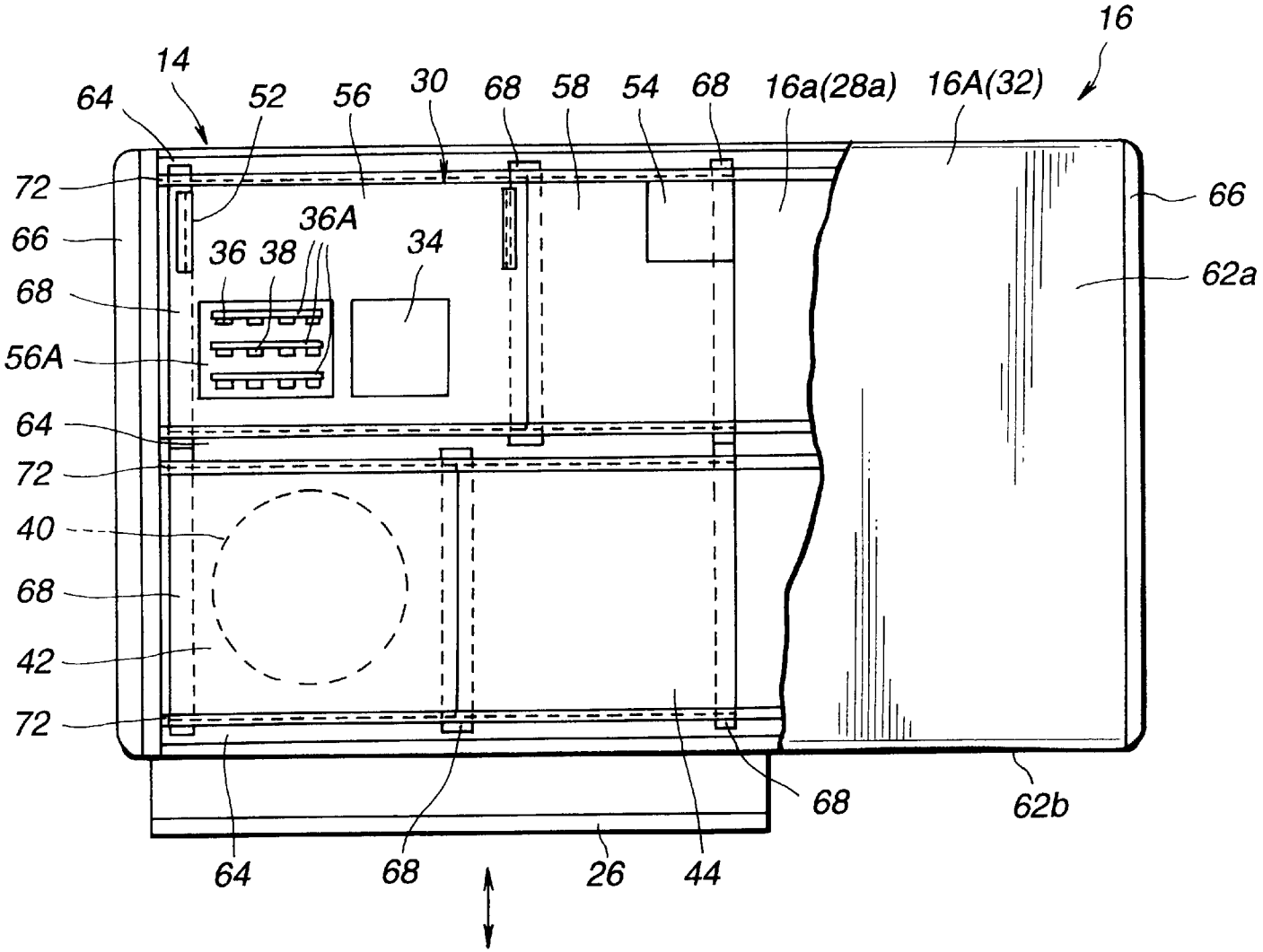
FIG. 2 is an enlarged plane view of a top panel of the desk of FIG. 1 in which a personal computer function units with a portion thereof broken away.

The personal computer body 14 comprises personal computer function units 30 serving to make an arithmetic and logic operative treatment and a cabinet 32 to contain the personal computer function units 30. As shown in FIGS. 1 and 2, the personal computer function units 30 may include a CPU 34, a memory such as a RAM 36 and a ROM 38, a hard disk drive 42 including a hard disk 40, a power source 44 having a power source switch 46, an FD drive 48 and a CD-ROM drive 50 which are serving to drive external memories, an expansion slot 52 into which an expansion board not shown is to be inserted, a MODEM 54, a mother board 56 to mount the CPU 34, the RAM 36 and the ROM 38 thereon and connect each to other, an interface board 58 to electrically connect the internal units to external peripheral equipment and a reset switch 60.

It should be noted that the personal computer function units 30 are not limited to the aforementioned units and may include various parts and/or electrical connection or combination of them directly involved in the operative treatment in the same manner as the conventional personal computer as a unit comprising the personal computer body and the particular cabinet therefor is involved. Thus, it will be noted that the personal computer function unit or units 30 may be properly selected in accordance with their properties.

It will be also noted that the personal computer function units 30 may include at least the CPU 34 and the RAM 36 which are inevitably required to perform the arithmetic and logic operative treatment as the personal computer. It may also include a MO drive for driving a magneto optical disk (MO referred to as hereinafter) and/or a DVD drive for driving a digital video disk (DVD referred to as hereinafter).

It should be understood that the personal computer function unit or units 30 may include unit or units corresponding to what is called "the personal computer body" of the personal computer, but exclude a unit or units for such peripheral equipment as a display unit, an input unit (a key board or a mouse, for example) and an output unit (a printer, for example). However, the invention never excludes the personal computer housed desk having such peripheral unit or units as well housed therein.

In the invention, the desk forming member 28 of the desk body 12 having a cavity or inner hollow thereof which should be noted is empty in case of the conventional desk serves as or forms the cabinet 32 of the personal computer body 14 and therefore, a part, parts or all of the personal computer function units 30 are contained in the cavity of the desk forming member 28.

Figure 3:
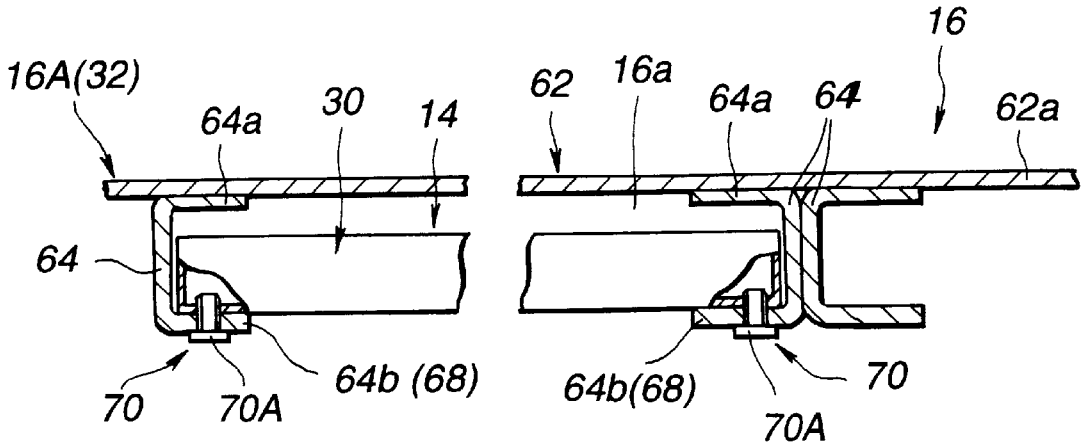
FIG. 3 is an enlarged cross sectional view of a portion of the top plate panel on which the personal computer function unit is supported inn accordance with one embodiment of the invention.

More particularly, in the illustrated embodiment, the top plate panel 16A itself serves as the cabinet 32 of the personal computer body 14 and the personal computer function units 30 are contained in the cavity or inner hollow 16*a* of the top plate panel 16A as shown in FIGS. 1 through 3. Thus, it will be noted that the top plate panel 16A itself covers and supports the personal computer function units 30 directly as if the top plate panel 16A is formed of a part of the personal computer body 14 as the cabinet 32 thereof and therefore the top plate member 16 including the top plate panel 16A functions as the personal computer body 14.

Thus, since there is required no particular containing space for the personal computer body 14 according to the personal computer housed desk of the invention, there can be expected a space saving for the personal computer. Also, since the personal computer function units 30 are contained in the cavity or inner hollow 16*a* of the top plate panel 16A as shown in FIGS. 1 through 3, various parts such as the CPU 34 and other units which are the personal computer function units 30 may be arranged and contained in the desk forming member 28 such as the top plate panel 16A in an effective manner in accordance with the configuration of the desk forming member 28. It should be understood that the personal computer function units 30 are contained in the cavity or inner hollow 16*a* thereof, but not in the containing space such as the drawer 26 which performs the original function of the desk. Thus, it will be noted that the desk never loses the original function of the desk, which is to contain such articles as stationery or the likes and also that it never damages the appearance of the desk because of the personal computer body hidden by the desk forming member 28.

Also, as shown in FIG. 1, the personal computer housed desk 10 may be so designed as to have a configuration as well as patterns and/or colors in view of the appearance in the same manner as the conventional desk having no personal computer contained. This allows the personal computer housed desk 10 to have a decorative appearance insured in accordance with user's taste and also to be designed in view of harmony with other furniture as an interior decoration as well as in view of its function. Thus, it will be noted the personal computer housed desk 10 of the invention can be more easily accepted to families as well as to offices.

It should be understood that the personal computer housed desk 10 of the invention is formed not by containing the personal computer body having a predetermined appearance and model as the ready made article or the finished article in the particular containing space of the desk formed to the appearance and model thereof as in the prior art, but by containing the personal computer function units 30 forming the personal computer body 14 in the vacant cavity of the desk forming member 28 of the desk 10, which cavity is never used for containing anything. Thus, the desk of the invention may have the appearance substantially identical to that of the conventional desk as shown in FIG. 1 and also a large space maintained under the top plate member 16 in the same manner as the conventional desk having no personal computer contained, which is substantially different from the prior art. It will be understood that this large space under the top plate member 16 allows the side box 24 including the drawers 22 and the shallow drawer 26 under the top plate member 16 to be provided therein. Of course, the body portion of the operator such as its legs as well as a chair can enter the large space under the top plate member 16.

As noted from FIG. 1, since the top plate member 16 has neither the personal computer body nor its function unit mounted thereon, it can be used for doing desk work other than the operation of the personal computer even when the personal computer is to be operated. Thus, it will be noted that the desk of the invention can be considered to be a personal computer having the form of a desk and therefore it can be called a desk type personal computer, which is different from a desktop type personal computer.

A part, or parts or all of the personal computer function units 30 may be contained in the top plate panel 16A in the manner as described in details hereinafter.

First, how the personal computer function units 30 are held in the top plate panel 16A will be described. The top plate panel 16A may be formed of metal material such as steel plate or iron plate, for example. As shown in FIGS. 2 and 3, the top plate panel 16A may comprise a top panel body 62 including an upper plate portion 62*a* which may be formed of iron plate or the like by bending it in the same manner as the conventional top plate panel having no personal computer body contained is formed, a plurality of beams 64 also formed of iron plate or the like by bending it and secured to the upper plate portion 62*a* on its inner face by welding for reinforcing the top plate panel body 62 and a pair of side frames 66 secured to the top panel body 62 for reinforcing it at its side by welding. The cavity or inner hollow 16*a* is formed by being defined by the beams 64 and the side frames 66. The beams 64 may be provided in one or some of a lateral direction, a longitudinal direction and an oblique or diagonal direction, but preferably in the longitudinal direction that is in a rightward or leftward direction because of improvement of the strength of the top plate panel 16 as shown in FIG. 2.

The beams 64 may be generally in the cross section form of C shape as shown in FIG. 3 and therefore it has a pair of upper and lower side walls 64*a* and 64*b*. The upper side wall 64*a* is secured to the upper plate portion 62*a* of the plate panel body 62 by welding while the lower side wall 64*b* serves as a holding member 68 for holding or supporting the personal computer function units 30. As shown in FIG. 3, various parts forming the personal computer function units 30 may be held in the cavities 16*a* defined by the beams 64 while they are supported on and between the lower side walls 64*b* of the opposite beams 64.

The holding member 68 may be preferably provided with fixing means 70 such as screw bolts 70A for fixing the personal computer function units 30 to the holding member 68 which is the lower side wall 64*b* in the embodiment of FIG. 3. A plurality of through holes may be provided in the beams 64 while a plurality of threaded holes may be provided in the personal computer function units 30 as shown in FIG. 3. The screw bolts 70A may extend through the through holes in the beams 64 and be threadedly engaged with the threaded holes in the personal computer function units 30, but the through holes and the threaded holes may be provided at a proper location in accordance with the size and/or the configuration of the personal computer function units 30. It will be understood that the fixing means 70 may be not limited to a combination of the screw bolts 70A and the threaded holes and may be an engaging piece, an engaging hook, a protrusion or the like. The engaging piece or the engaging hook may be removably inserted into one of fixing holes in the beams 64 so that the personal computer function units 30 are fixed to the beam 64. The fixing holes in the beams 64 may be provided at a proper position of the beams 64 where the personal computer function units 30 are supported. The beams 64 may be properly provided in the top plate panel body 62 to the configurations of the parts forming the personal computer function units 30 while the strength of the top plate panel body 62 is considered.

The personal computer function units 30 may be held in the manner other than that aforementioned with reference to FIG. 3 as long as they are contained in the vacant cavity in the desk forming member 28 such as the top plate panel 16A serving as the cabinet for the personal computer body 14 and unless the top plate panel 16A has a configuration considerably different from that of the conventional desk.

Figure 4:
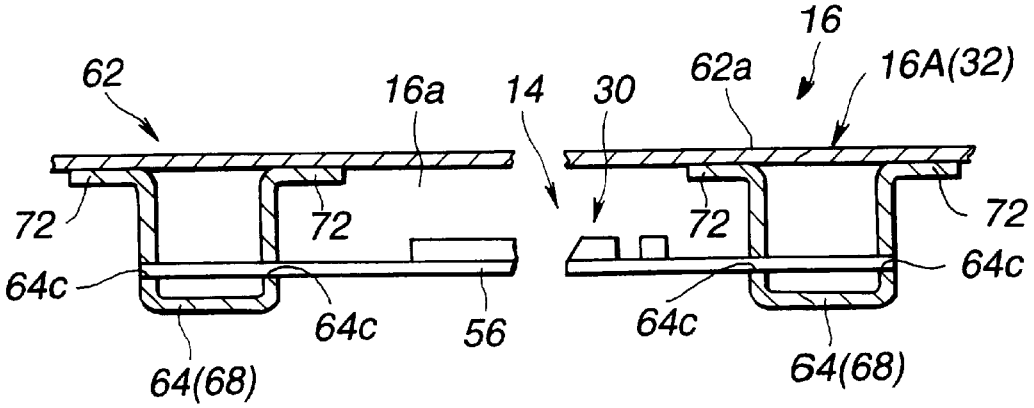
FIG. 4 is a cross sectional view of a portion of a top plate panel corresponding to that of FIG. 3, but constructed in accordance with a first modification embodiment of the invention.

As shown in FIG. 4, for instance, the beams 64 may be in the form of U-shape and have flanges 72 secured to the upper plate portion 62*a* of the top plate panel body 62 by welding so that an opening of the beams 64 is closed by the upper plate portion 62*a* as in the conventional desk and engaging holes 64*c* may be provided in the beams 64 for holding the personal computer function units 30 while they extend through and engaged with the engaging holes 64*c* in the adjacent beams 64 across them. Thus, it will be noted that the beams 64 having the extension holes 64*c* serve as the holding member 68 for the personal computer function units 30.

Although, in the illustrated embodiment, the parts forming the board type personal computer function units 30 such as the mother board 56 or the like are shown to be held on the beams 64 as shown in FIG. 4, the parts forming the box-like personal computer function units 30 such as the hard disk drive or the like may be held on the beams together with as well as instead of the board type personal computer function units 30. In the latter case, the box-like hard disk drive 42 may have holding pawls provided thereon and caught by the engaging holes 64*c* so that it is held on the beams 64 although not shown.

Figure 5A:
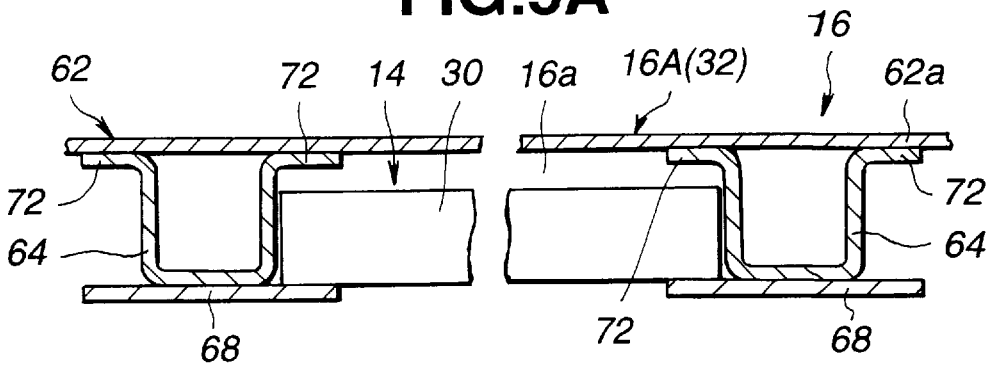
FIG. 5A is a cross sectional view of a portion of a top plate panel corresponding to that of FIG. 3, but constructed in accordance with a second modification of the invention.
Figure 5B:
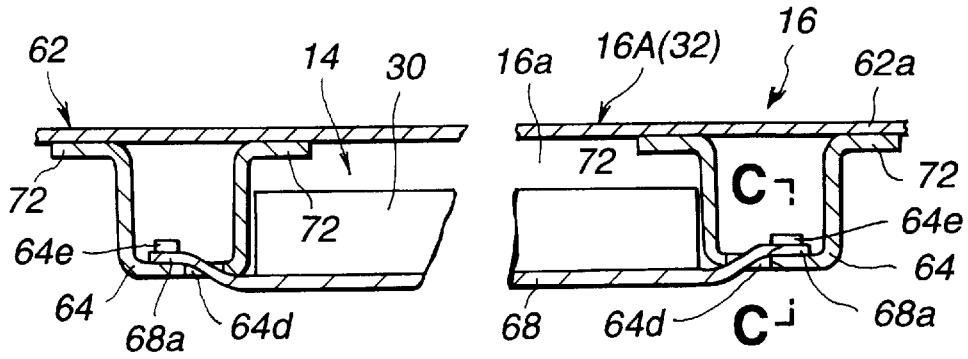
FIG. 5B is identical to the top plate panel of FIG. 5A, but showing the personal computer function unit mounted in a different manner.
Figure 5C:
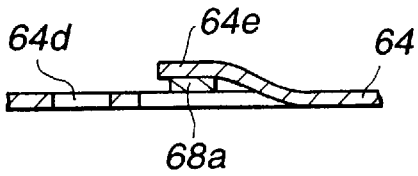
FIG. 5C is a sectional view of the top plate panel taken along a line of C—C of FIG. 5B.
Figure 5D:
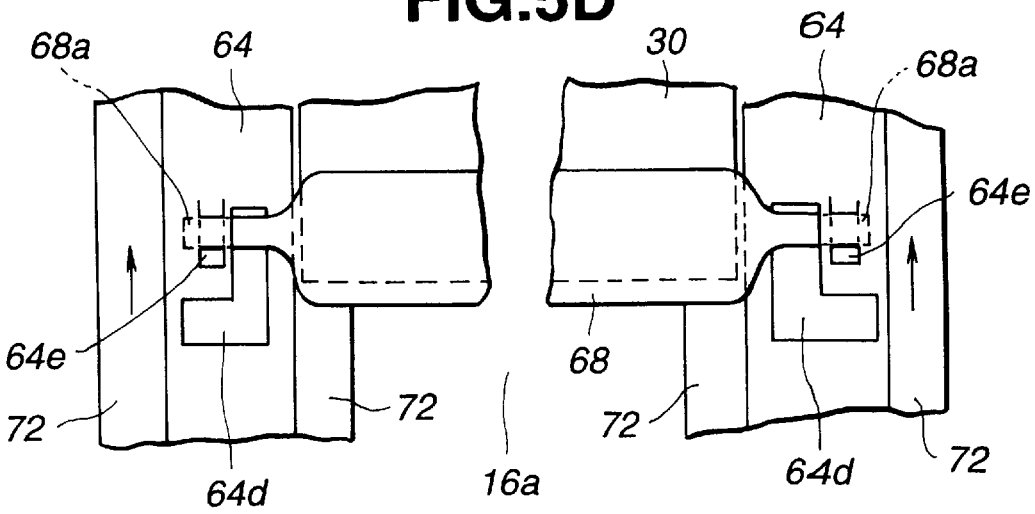
FIG. 5D is a bottom view of the top plate panel of FIG. 5B.

Alternatively, a particular holding member or members 68 other than the beams 64 may be provided for holding the personal computer function units 30. More particularly, although the top plate panel 16A of the desk body 12 has the beams 64 provided thereon as shown in FIG. 5A, a separate holding member or members 68 for holding the personal computer function units 30 may be provided on the beams 64 so that they horizontally extend from the bottom of the beams 64 as shown in FIG. 5A. Otherwise, a strip-like or arm-like holding member or members 68 may be provided across and between the adjacent beams 64 so that both ends of the holding members 68 are suspended from the beams 68 as shown in FIGS. 5B through 5D. It should be noted that the personal computer function units 30 of FIG. 2 are held in the manner as shown in FIGS. 5B through 5D.

As shown in FIGS. 5B through 5D, the strip-like or arm-like holding members 68 may have hooks 68*a* provided on both ends thereof while the beams 68 may have through holes 64*d* provided therein in the form of L-shape as viewed in FIG. 5D and fixing hook pieces 64*e* formed by partially cutting and upwardly raising up the beam material. The hooks 68*a* of the holding member 68 extend through the L-shaped through holes 64*d* in the beams 64 and securely engaged with the fixing hook pieces 64*e* of the beams 64 in a removable manner. Thus, it will be noted that the strip-like or arm-like holding member 68 may be fixed to the beams 64 and removed out thereof so that the personal computer function units 30 may be fixed at a selected position of the beams 64. In the same manner as the personal computer function units 30 are fixed to the beams 64, the strip-like or arm-like holding members 68 may be removably fixed to the beams 64 by means of threaded bolts so that they may be disposed at any suitable position.

Figure 6A:
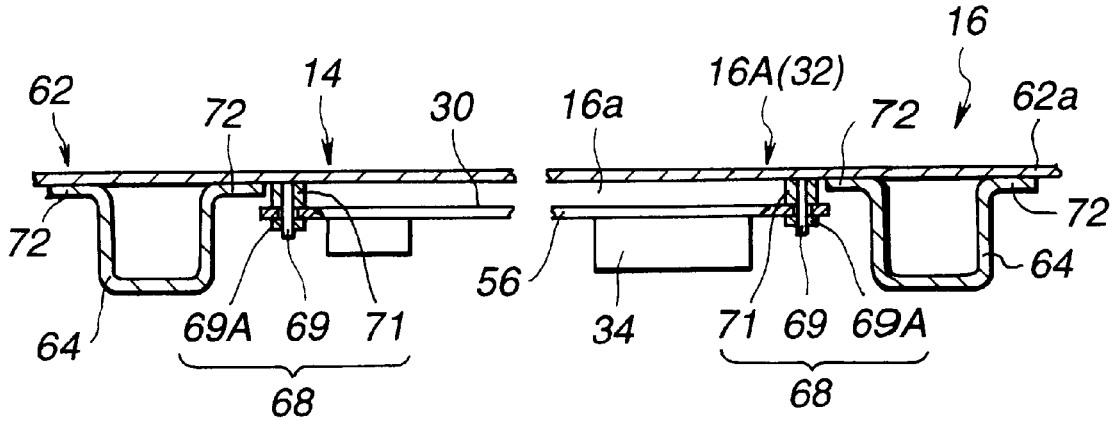
FIG. 6A is similar to the top plate panel of FIG. 4, but showing a mother board as the personal computer function unit mounted thereon in a different manner.
Figure 6B:
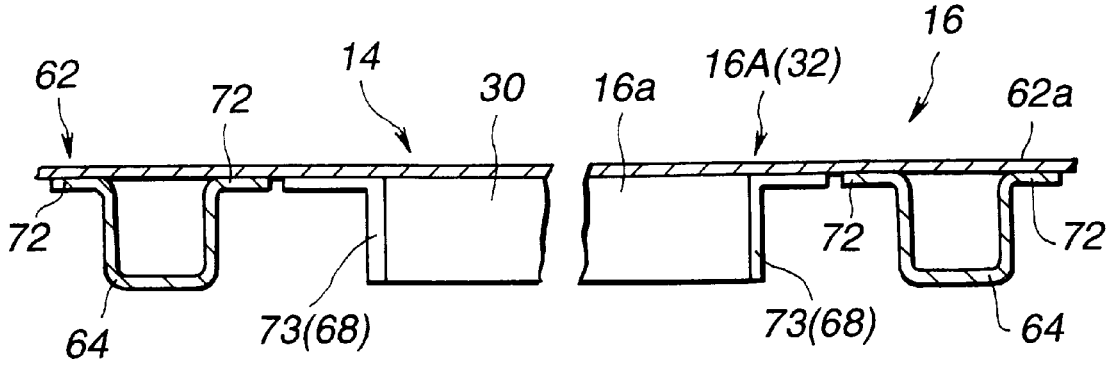
FIG. 6B is similar to that of FIG. 6A, but showing a hard disk drive as the personal computer function unit mounted thereon.

As shown in FIG. 6, holding members 68 for holding the personal computer function units 30 on the top plate panel 16A may be provided on the lower face of the upper plate portion 62*a* of the top plate panel 16A on an area between the adjacent beams 64. More particularly, the holding members 68 may comprise stud bolts 69 of FIG. 6A or L-shaped brackets 73 of FIG. 6B secured to the lower face of the upper plate portion 62*a* by welding or the like.

As shown in FIG. 6A, the board-like personal computer function units 30 such as the mother board 56 or the like may have bolt extension holes provided in both ends thereof and may be fixed to the top plate panel 16A with the stud bolts 69 extending through the bolt extension holes in the mother board 56 and with nuts 69A threadedly engaged with the stud bolts 69 so as to force the mother board 56 against cushion colors 71 which are in turn positioned between the upper plate portion 62*a* and the mother board 56. As noted from FIG. 6A, the personal computer function units 30 such as the mother board 56 may be preferably disposed with a packaging face such as a face having the CPU 34 or the likes provided being directed in a downward direction while they are positioned within the vacant cavity or hollow 16*a* of the top plate panel 16A.

As shown in FIG. 6B, the box-like personal computer function units 30 such as the hard disk drive 42 or the like may be removably fixed across a space between the adjacent L-shaped brackets 73 by screws not shown.

As noted from FIG. 6, the cavity or inner hollow 16*a* of the top plate panel 16A which might be otherwise vacant without any part being disposed can be effectively used for containing the personal computer body 14. Also, it will be noted that a modification of the top plate panel 16A from the conventional type one would be slightly made for containing the personal computer body 14. This allows the desk 10 to be produced in a manner substantially similar to that of the conventional desk.

Although the personal computer function units 30 may be preferably held with the parts thereof such as the CPU 34 faced in a downward direction as shown in FIG. 6A, they may be held with the parts faced in a upward direction by setting the length of the holding members 68 such as the stud bolts 69 so that they are longer than those of FIG. 6A and as a result enables the parts to be positioned between the mother board 56 and the upper plate portion 62*a* of the top plate panel 16A. Similarly, the box-like personal computer function units 30 shown in FIG. 6B may be held with the parts thereof faced either in an upward direction or in a downward direction.

Figure 7A:
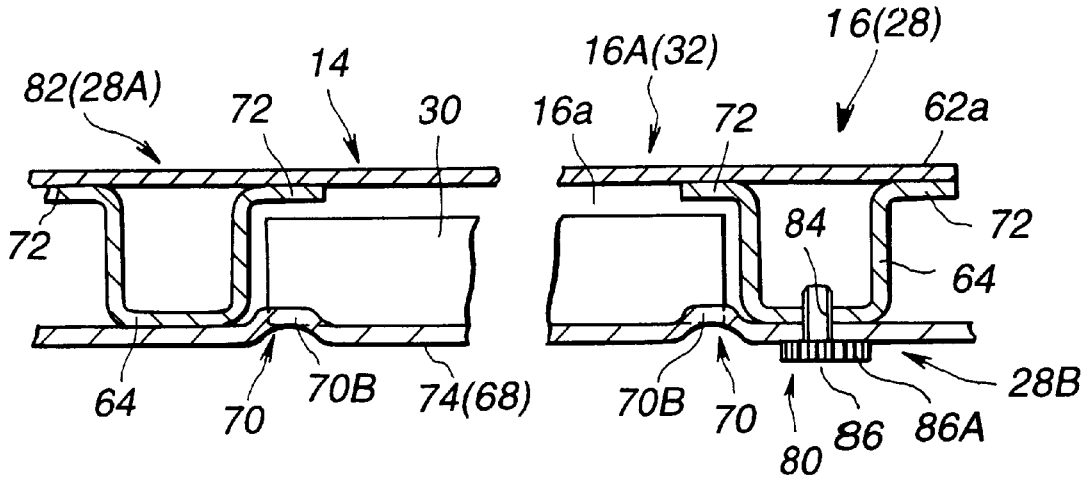
FIG. 7A is a cross sectional view of a portion of a top plate panel having a lower cover provided thereon and showing a personal computer function unit mounted on the lower cover.

Alternatively, as shown in FIG. 7A, the top plate panel 16A may be provided with a lower cover 74 on which the personal computer function units 30 may be mounted and held. The personal computer function units 30 may be held in position by raised portions 70B as fixing means 70 formed by partially deforming the lower cover 74 for positioning the personal computer function units 30 with or without the screw 70A for fixing the personal computer function units 30 even though they may be held only by the screw 7OA without the raised portions 70B in the same manner as shown in FIG. 3. It will be understood that the personal computer function units 30 such as the hard disk drive 42, the power source 44, the mother board 56, the interface board 58 or the likes can be held with the four corners thereof resiliently engaging the raised portions 70B of the lower cover 70 while they are prevented by the raised portions 70B from being shifted out of place.

Although, in the aforementioned embodiments, the personal computer function units 30 may be securely held within the top plate panel 16A by the holding members 68 and the fixing means 70 so that they are prevented from being easily removed or shifted out of place while the desk 10 is conveyed as well as used for desk work, the personal computer function units 30 may be desirably removed out of place by removably or slidingly holding them for checking or repairing them. The desk forming members 28 such as the top plate panel 16A may be formed of materials such as synthetic materials or wooden materials other than metal materials, to which as the result it will be noted the materials of the desk forming members 28 are not limited.

Next, how the personal computer function units 30 are arranged within the top plate panel 16A will be described herein just below. As shown in FIGS. 1 and 2, the CPU 34, the RAM 36 formed of IC such as DRAM, the ROM 38 and the expansion slot 52 may be mounted on the mother board 56. The interface board 58, the hard disk drive 42 including the hard disk 40, the power source 44 and the MODEM 54 as well as the mother board 56 having the aforementioned units mounted thereon may be contained within the cavity or inner hollow 16*a* of the top plate panel 16A which is located above and corresponding to the shallow drawer 26 slidingly mounted on the top plate panel 16A. The memory formed of IC such as the RAM 36, the ROM and the likes may be mounted on shim-like insertion pieces 36A which are in turn inserted into memory slots 56A of the mother board 56 so that the memory is connected thereto.

Figure 7B:
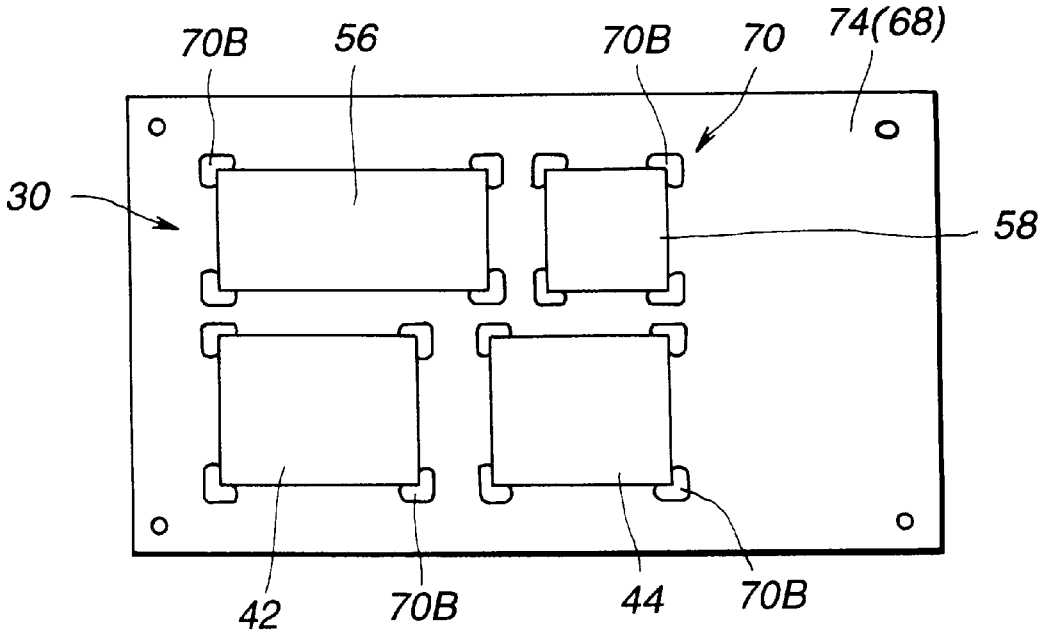
FIG. 7B is a plane view of the lower cover of FIG. 7A.

With the personal computer function units 30 contained within the cavity or inner hollow 16*a* of the top plate panel 16A above and corresponding to the shallow drawer 26, the latter serves to protect the personal computer function units 30 within the top plate panel 16A from the exterior atmosphere such as dust or dirt even if the top plate panel 16A is open without any lower cover as indicated by a reference numeral 74 in FIG. 7. In addition thereto, the operator may be accessible to the personal computer function units 30 within the top plate panel 16A by removing the shallow drawer 26 out of the top plate panel 16A. Thus, it will be noted that the personal computer function units 30 within the top plate panel 16A may be easily checked, maintained, repaired or expanded in its function. Although described later, the lower cover 74 may be preferably removable relative to the top plate panel 16A so that the personal computer function units 30 may be exposed by removing the shallow drawer 26 out of the top plate panel 16A and opening the lower cover 74.

It will be noted that since the CPU 34, the RAM 36, the ROM 38 and the expansion slot or slots 52 among the personal computer function units 30 may be mounted on the mother board 56, they have no particular holding member required. On the other hand, the mother board 56, the hard disk drive 42, the power source 44 and the MODEM 54 may be held on the holding members 68 and electrically connected to each other while they are contained within the top plate panel 16A.

In the illustrated embodiment, other personal computer function units 30 including exchangeable memory drives for driving an external memory such as an FD drive 48 and a CD-ROM drive 50 and such units as a power switch 46 and a reset switch 60 which may be desirably operated by an operator from the outside may be preferably arranged on a front face of the desk body 12 as shown in FIG. 1. This allows the units to be easily operated by the operator from the outside and also prevents the desk body 12 from damaging the appearance and the original function thereof while the good operation of the personal computer body 14 is maintained.

In the illustrated embodiment, the FD drive 48, the CD-ROM drive 50, the power switch 46 and the reset switch 60 are contained not in the top plate panel 16A, but in an upper panel portion 24A of the side box 24 which is located on the side of the shallow drawer 26 as shown in FIG. 1. This preferably prevents the units 48, 50, 46 and 60 from being erroneously operated because of the upper panel portion 24A of the side box 24 positioned slightly backward from the front face of the top plate panel 16A so that the front face of the upper panel portion 24A is withdrawn from the front frame 62*b* of the top plate panel 16A. However, it should be noted that the position where these units are positioned is limited thereto, but these units 48, 50, 46 and 60 may be arranged within the top plate panel 16A together with the other personal computer function units 30 so that they may be positioned on the front face of the top plate panel 16A.

As noted from the foregoing, how each of the personal computer function units 30 is arranged is not limited to the particular arrangement and they may be arranged with an appropriate layout employed. For instance, all the personal computer function units 30 may be contained in the cavity or inner hollow 16*a* of the top plate panel 16A corresponding to the position where the shallow drawer 26 is located and also to the position where it is not located as well. Although, in the illustrated embodiment, the CPU 34, the RAM 36, the ROM 38 and the expansion slots 52 are mounted on the mother board 56, these units 30 to be mounted on the mother board may be optionally selected in accordance with the thickness and area of the top plate panel 16A.

The one or ones among the personal computer function units 30 which are to be arranged so as to appear in front of the desk body are not limited to the aforementioned units 48, 50, 46 and 60, but they may be voluntarily selected. Thus, it will be noted that the reset switch 60 may be omitted and that if the reset switch 60 may be provided, it is not required to be arranged on a front face of the desk body 12. Exchangeable drives for external memories such as a DVD drive and an MO drive might be arranged so as to appear on a front face of the desk body 12.

Figure 8A:
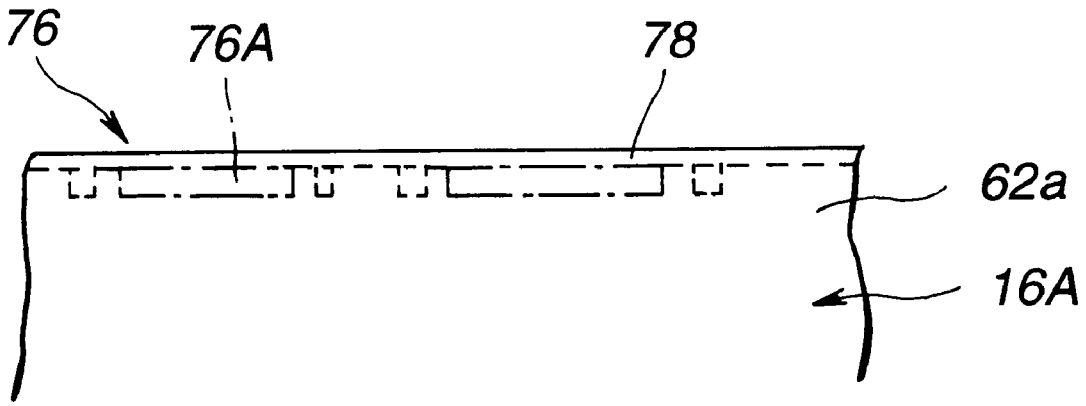
FIG. 8A is a brief plane view of a top plate panel having an external unit connection provided therein.
Figure 8B:
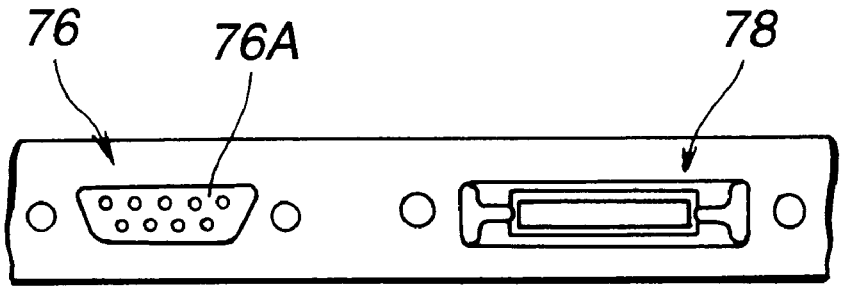
FIG. 8B is a front view of the top plate panel of FIG. 8A.

As shown in FIGS. 8A and 8B, the desk body 12 may be preferably provided with external memory connections 76 (only one connection 76A shown in FIGS. 8A and 8B) for connecting additional external units such as a hard disk drive and/or a memory drive to the personal computer body 14. It will be understood that the additional external units may be preferably contained in the desk forming member 28 such as the top plate panel 16A, for instance. It will be noted that the external memory connections 76 allow the additional external unit or units such as the hard disk to be easily connected to the personal computer body 14 so as to expand the function thereof.

As shown in FIGS. 8A and 8B, the external memory connections 76 may comprise a connection terminal 76A which may be electrically connected through the interface board 58 to the other personal computer function units 30 within the top plate panel 16A. In the illustrated embodiment, the connection terminal 76A may be provided on a back face of the top plate panel 16A as shown in FIGS. 8A and 8B. Thus, the connection terminal 76A disappears from the front face of the desk body 12, which prevents the desk 10 from damaging the function and appearance thereof. Of course, the connection terminal 76A may be provided on the front face of the desk body 12 and in this case, it may be covered by a movable cover so as not to damage the appearance of the desk and also so as to protect the connection terminal 76A from dust and dirt, but can be opened so as to connect the external memory thereto. Also, the external memory connection 76 which is provided on the back face of the desk body 12 as shown in FIGS. 8A and 8B may be covered by a movable cover so as to protect it from dust and dirt in the same manner.

As the external memory such as the additional hard disk is connected to the connection terminal 76A, it becomes a part of the personal computer function units 30 to involve the operative treatment, but it may be provided not in the desk forming member 28, but on the desk top face or the floor. Thus, it will be noted that all the personal computer function units 30 are not required to be necessarily contained in the desk forming member 28. All the invention requires is that the main essential units including the CPU 34 and the RAM 36 among the personal computer function units 30 are contained in the desk forming member or members 28 for saving a space without any damage of the original function and appearance of the desk 10. The additional function units 30 which may be used for expansion of the function of the personal computer body 14 and easier operation thereof may be arranged outside of the desk 10.

As shown in FIGS. 8A and 8B, the desk 10 of the invention which serves as the personal computer body 14 may have peripheral equipment connections 78 provided in the desk forming member 28 such as the top plate panel 16A for connecting various peripheral equipments not shown and including a display unit such as a CRT display, an input unit such as a key board or a mouse, an output unit such as a printer and/or an external MODEM although only one of the peripheral equipment connections 78 is shown in FIGS. 8A and 8B. The peripheral equipment connections 78 may be disposed on the back face of the top plate panel 16A in the same manner as the external memory connections 76, but may be alternatively disposed on the front face of the top plate panel 16A and be closed by covers.

In this manner, the desk forming member or members 28 containing all or parts of the personal computer function units 30 which may preferably be the top plate panel 16A as in the illustrated embodiment may be removably assembled with the other desk forming members 28 which may be a leg member 18A, a back plate panel 20 and a side plate panel 24B for the side box 24 in the illustrated embodiment. More particularly, the top plate panel 16A may be removably assembled with the other desk forming members 28 by fixing means which may be in the form of bolt-nut type, fitting type or hooking type. It should be noted that the desk 10 may be a knock-down type one which is formed by assembling the desk forming member or members 28 containing the personal computer function units 30 with the other desk forming members 28 not containing them by bolt-nut means.

The top plate panel 16A containing the personal computer function units 30 can be more carefully treated when conveyed. This more effectively prevents the computer function of the personal computer housed desk 10 from being damaged, which cannot be expected in case the whole desk 10 which is not in the form of knock-down type is conveyed.

It should be noted that the top plate 16 or the top plate panel 16A serving as the personal computer body 14 can be more easily exchanged for the new-functional one when the personal computer body 14 in the top plate 16 or the top plate panel 16A becomes old-functional. This allows the personal computer housed desk 10 to get higher grade with only the top plate panel 16A exchanged and without exchanging the whole desk 10.

There may preferably be assembling means 80 for assembling all or parts of the desk forming members 28 containing the personal computer function units 30 so that they may be able to be opened and/or disassembled. This allows an operator to be accessible to all or parts of the personal computer function units 30.

Thus, it will be noted that the personal computer function units 30 can be checked, maintained or repaired by opening or removing the desk forming members 26 so as to have access to the personal computer function units 30.

Referring to FIGS. 9 and 7, there is shown one of the assembling means 80. The desk forming member or members 28 containing all or some of the personal computer function units 30 may comprise forming member stationary body 28A and forming member movable body 28B movably provided on the stationary body 28A.

As noted from FIGS. 9A through 9C and 7 in which the desk forming member 28 containing the personal computer function units 30 is the top plate panel 16A, the top plate panel 16A may comprise a top plate panel body 82 (forming member stationary body 28A) and a lower cover 74 (forming member movable body 28B). The top plate panel stationary body 82 may include the top plate panel body 62, beams 64 and side frames 66 (see FIG. 1). The assembling means 80 may comprise threaded holes 84 formed in the beams of the top plate panel stationary body 82 and fixing screws 86 to be threadedly engaged with the threaded holes 84 in the stationary body 82.

Figure 9A:
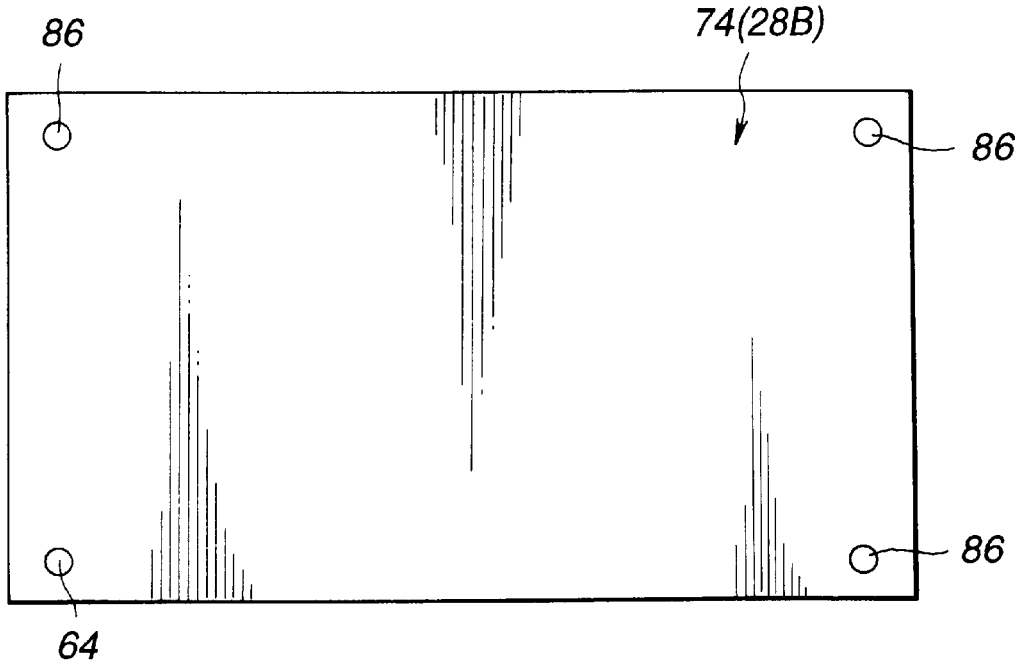
FIG. 9A is a bottom view of a top plate panel provided with assembly means according to further embodiment of the invention.
Figure 9B:
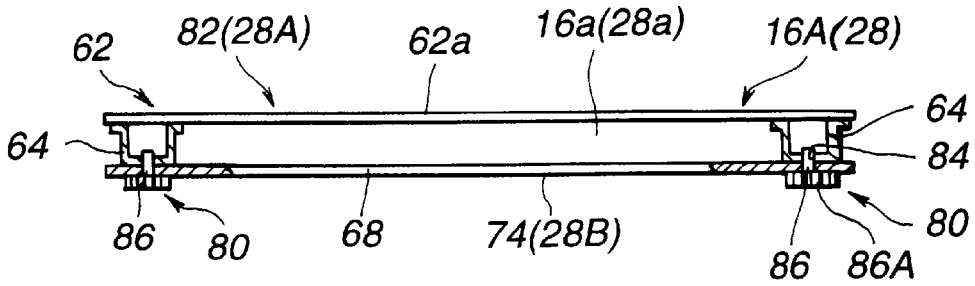
FIG. 9B is a side elevational view of the top plate panel of FIG. 9A.
Figure 9C:
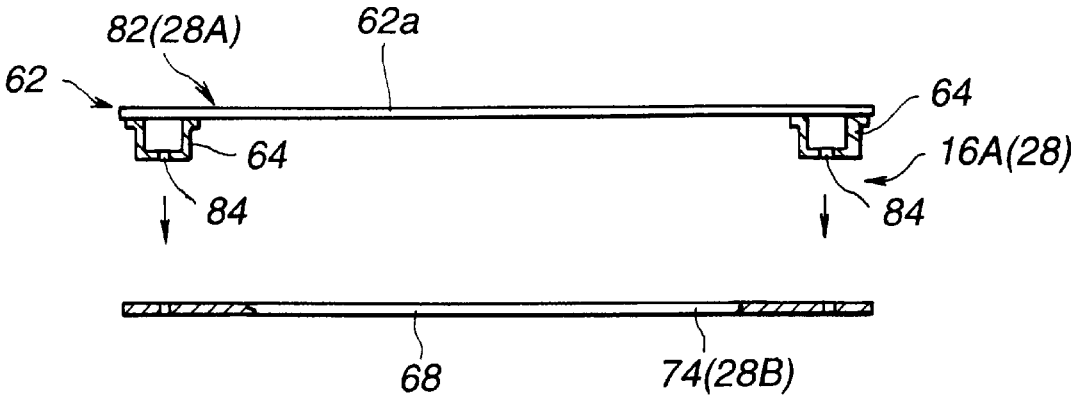
FIG. 9C is similar to FIG. 9B, but showing the top plate panel disassembled.

As shown in FIGS. 9A and 9B, the lower cover 74 as the forming member movable body 28B may be held on the top plate panel stationary body 82 by tightly engaging the holding screws 86 with the threaded holes 84 in the top plate panel stationary body 82 and removed out thereof by loosely disengaging and removing the holding screw 86 out of the top plate panel stationary body 82. This facilitates the operations such as maintenance and/or expansion of their functions of the personal computer function units 30 within the top plate panel 16A. Thus, it will be understood that the lower cover 74 used as the holding member 68 of the personal computer function units 30 may be desirably held by the top plate panel body 82 by the assembling means 80 in such a manner as the lower cover 74 may be able to be removed, disassembled or opened as shown in FIGS. 7 and 9A through 9C. It will be also understood that the removably assembling means 80 serves as means to have access to the personal computer function units 30 contained within the desk forming members 28.

In the illustrated embodiment, four holding screws 86 may be used for holding the lower cover 74 onto the top plate panel body 82 at their four positions, as shown in FIG. 9A, only two or six holding screws 86 may be used by holding it onto the top plate panel body 82 at its suitable two or six positions instead of the four positions in consideration of its holding strength. The holding screws 86 may preferably have an enlarged knurled head 86A for facilitating them to be manually tightened or loosed without using any tool, but may have a plus or minus groove provided in the head for tightening or loosing it by means of a manual tool such as a driver.

It will be understood that the lower cover 74 may be provided so as to surround either the whole lower face of the top plate panel 16A or the partial face thereof. Although, in the illustrated embodiment, the lower cover 74 may be provided so as to surround the face portion of the top plate panel 16A corresponding to the shallow drawer 26, it may be provided at the position where the shallow drawer 26 is not provided as well. A plurality of lower covers 74 may be provided at a plurality of positions in a divisional manner. In case that a separate type side box 24 is used or any side box is not used, the lower cover 74 may be provided so as to surround the whole lower face of the top plate panel 16A.

Figure 10A:
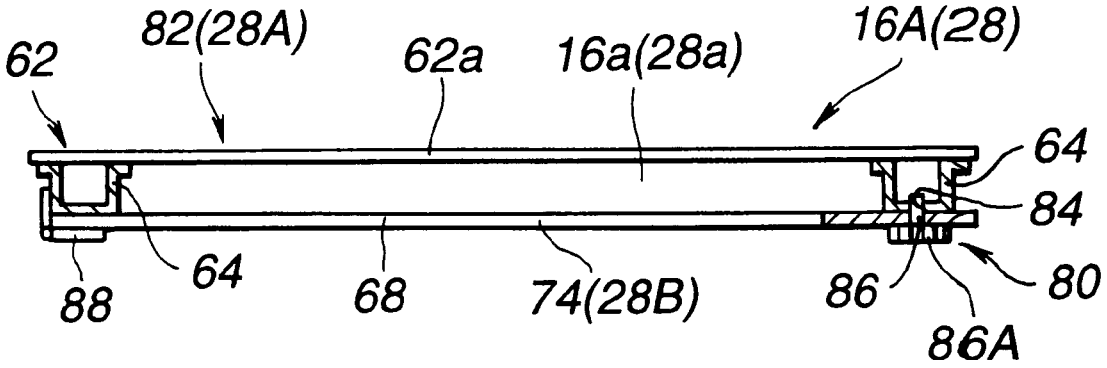
FIG. 10A is a side elevational view of a top panel provided with assembling means according to another embodiment of the invention.
Figure 10B:
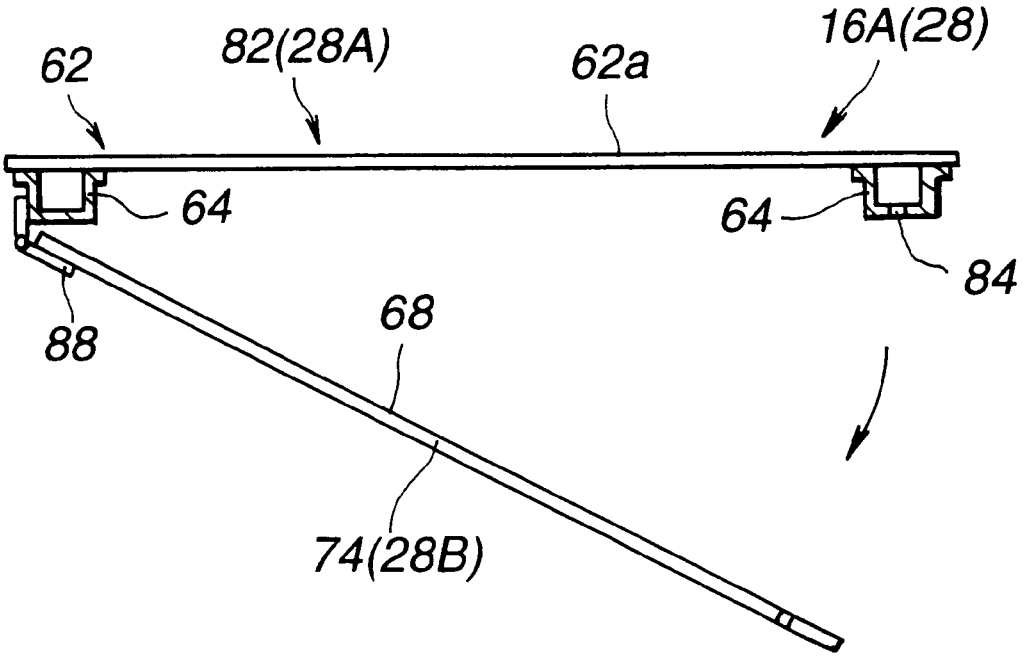
FIG. 10B is similar to FIG. 10A, but showing the top plate panel opened.

As aforementioned, the lower cover 74 may be held onto the top plate panel 16A not by the disassembling or removably assembling means 80, but by the opening type assembling means 80. More particularly, as shown in FIG. 10, the opening type assembling means 80 may comprise hinges 88 for pivotally holding the lower cover 74 at their one edge onto the top plate panel body 82 and the holding screws 86 and the threaded holes 84 in the top plate panel body 82 for fixing the other edge of the the lower cover 74 onto the top plate panel body 82 in the same manner as described with reference to FIGS. 7 and 9A through 9C. The lower cover 74 may be closed by tightening the holding screws 86 on the other edge of the lower cover 74 as shown in FIG. 10A while it may be opened by pivotally moving it about the hinge 88 after the holding screws 86 are removed so that the personal computer function units 30 within the top plate panel 16A may be easily maintained or repaired.

There may be provided the forming member movable body 28B other than the lower cover 74. For instance, although the lower cover 74 may be provided which serves as the holding member 68 so as to contain the personal computer function units 30 in the same manner as the embodiment of FIG. 7, the lower cover 74 holding the personal computer function units 30, the beams 64 and the side frame 66 serve as the stationary forming member stationary body 28A of the top plate panel body 82 while the upper plate portion 62*a* and the front frame portion 62*b* serve as the forming member movable body 82B as if they serve as an upper cover. In this case, the assembling means 80 may comprise the hinge 88 to pivotally hold the upper plate portion 62*a* onto the back edge of the forming member stationary body 28A and hooks 90 to secure the front frame 62*b* of the forming member movable body 28B to the forming member stationary body 28A. The hooks 90 may be replaced by the holding screws 86 and the threaded holes in the front beam 64 in the same manner as shown in FIGS. 7 and 9A through 9C.

Figure 11A:
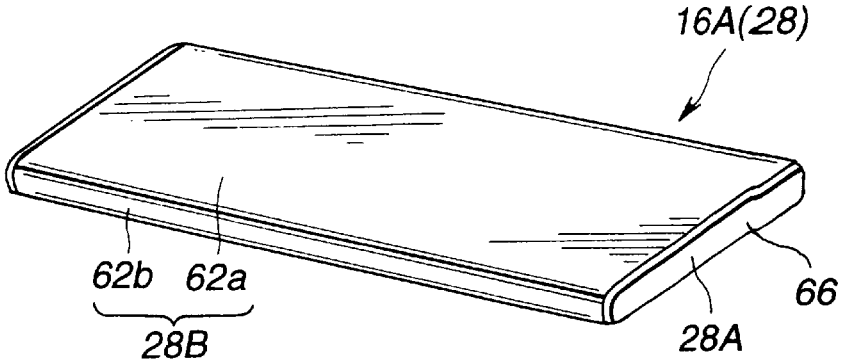
FIG. 11A is a perspective view of a top plate panel provided with assembly means according to further embodiment of the invention.
Figure 11B:
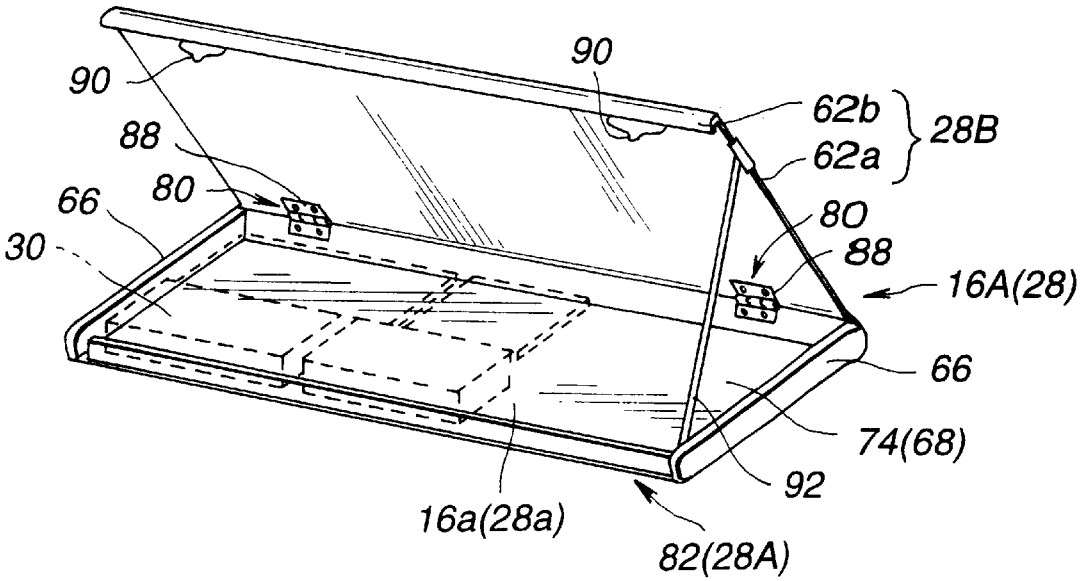
FIG. 11B is similar to FIG. 11A, but showing the top plate panel opened.

As shown in FIG. 11A, the upper plate portion 62*a* may serve as the top plate for doing various works such as an operation of the personal computer or the desk work by closing the upper top plate portion 62*a* in the same manner as the conventional desk and also serve as the top cover to open it together with the front frame 62*b* so as to have access to the personal computer function units 30 as shown in FIG. 11B. A tie member 92 such as a stay or tie bar to maintain the upper plate portion 62*a* and the front frame 62*b* as the forming member movable body 28B at the opened state may be preferably provided as shown in FIG. 11B.

In the assembly system of the embodiment of FIG. 11B, the hooks 90 to secure the front frame 62*a* may be omitted because the upper plate portion 62*a* and the front frame portion 62*b* as the forming member movable body 28B will be shifted due to their gravity so as to be automatically closed. It will be noted that only the upper plate portion 62*a* may be provided as the forming member movable body 28B while the front frame portion 62*b* may be a part of the forming member stationary body 28A of the top plate panel body 82, which is different from the embodiment of FIGS. 11A and 11B.

The upper plate portion 62*a* together with or without the front frame portion 62*b* may be assembled not by the opening type assembling means 80, but by the removing type assembling means 80 and disassembled or removed out of the lower cover 74 by loosing and removing the holding screws 86 out of the threaded holes 84.

Figure 12:
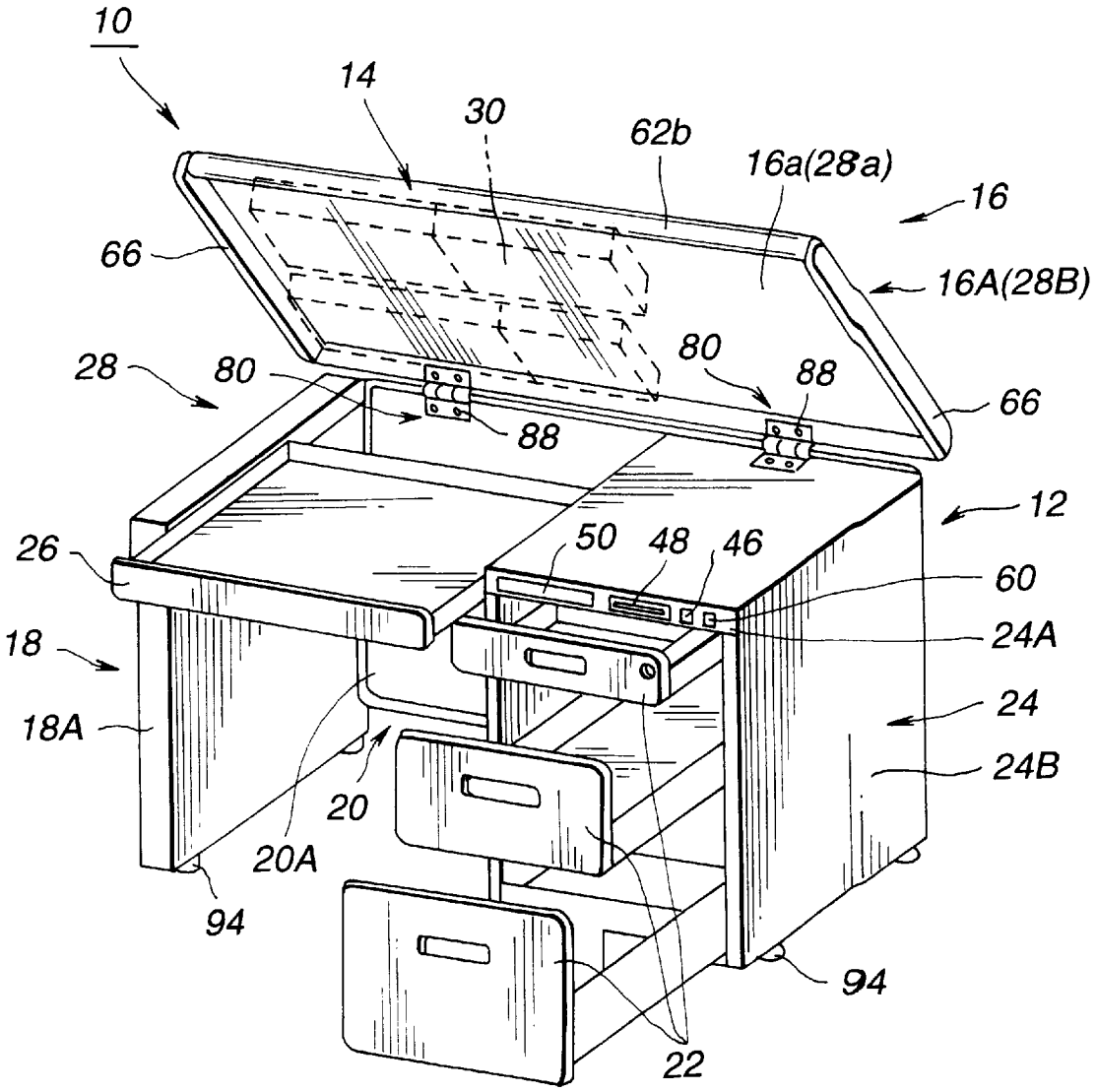
FIG. 12 is a perspective view of a personal computer housed desk provided with assembly means according to further embodiment of the invention.
Figure 13:
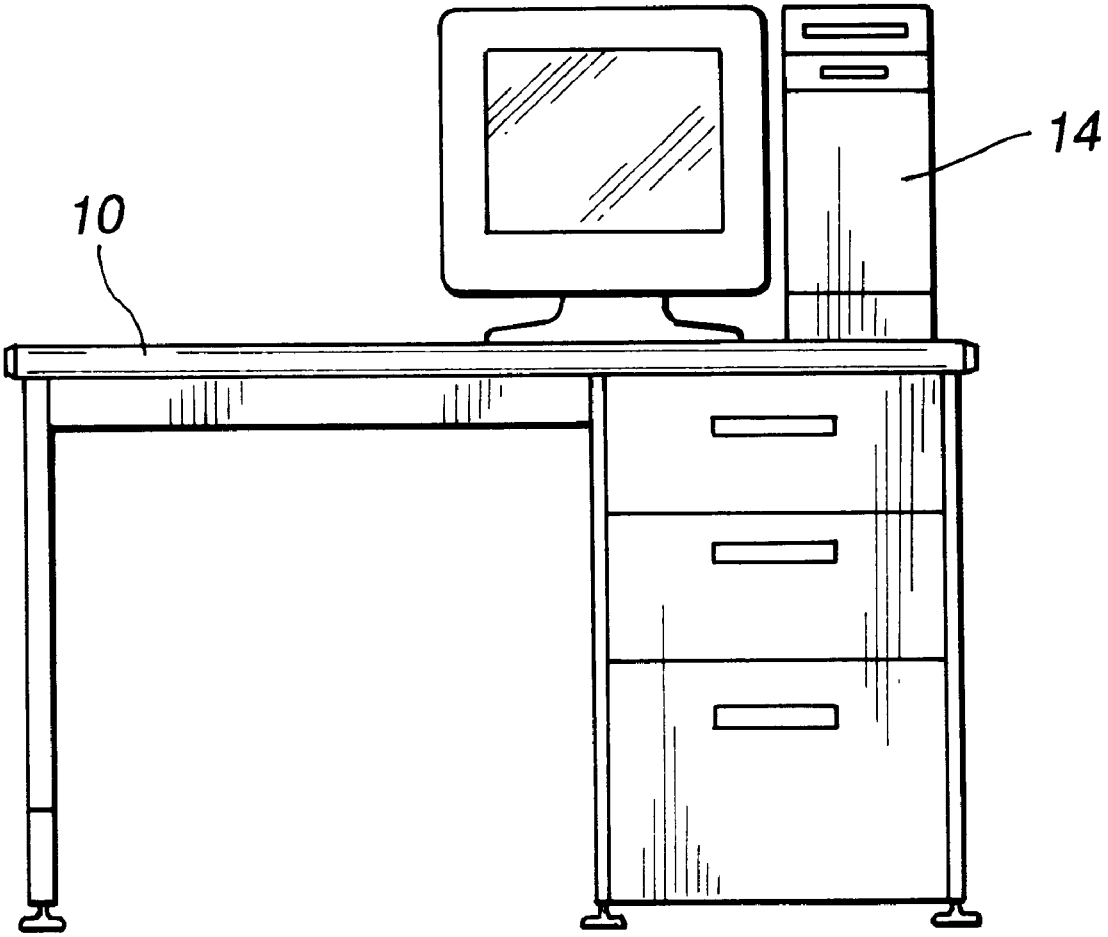
FIG.13 PRIOR ART
FIG. 13 is a front view of a desk on which a personal computer is mounted on the desk in accordance with a prior art.

Referring now to FIG. 12, there is shown an embodiment in which the entire desk forming member 28 containing the personal computer function units 30 may be able to be opened or disassembled. In the embodiment of FIG. 12, the desk forming member 28 containing the personal computer function units 30 is shown to be the top plate panel 16A which serves as the personal computer body 14. In this embodiment, the top plate panel 16A may be pivotally held onto the back plate panel 20 by using the hinge 88 as shown in FIG. 12 so that the top plate panel 16A serves as a top cover movably mounted on the other desk forming members 28. Thus, as the top plate panel 16A can be opened by being raised up, the operations such as the maintenance or the like of the personal computer function units 30 may be facilitated.

It will be noted that the holding member 68 for the personal computer function units 30 is formed by top plate panel 16A itself without using any lower cover 74. It will be noted that the personal computer function units 30 may be easily maintained or repaired by removing the shallow drawer 26 out of the desk body 12.

Even though the top plate panel 16A having no lower cover 74 provided can protect the personal computer function units 30 from the external environment because of the shallow drawer 26 covering the personal computer function units 30, the lower cover 74 may be preferably provided so as to cover the top plate panel 16A, which causes the personal computer function units 30 to be more effectively protected from the external environment. In this case, it will be noted that the lower cover would be mounted on the top plate panel 16A which is pivotally mounted on the desk body 12 so as to be able to be opened or removed out of the desk body 12. Such a lower cover may be provided so as to entirely or partially surround the lower face of the top plate panel 16A.

It will be understood that although the lower cover as the holding member for the personal computer function units 30 is not required as shown in FIGS. 3 through 6, such a lower cover having no holding function may be preferably provided for protecting the personal computer function units 30 from the external environment.

In the illustrated embodiments, the top plate panel 16A of the desk forming member 28 effectively serves as the cabinet 32 for the personal computer body 14 because the top plate panel 16A has the relatively larger area among the desk forming members 28 and facilitates an effective arrangement and receipt of the personal computer function units 30, but it will be understood that the desk forming member or members other than the top plate panel 16A together with or without the latter may serve as the cabinet 32 of the personal computer body 14.

More particularly, the desk forming member or members 28 such as the leg 18A, the side plate panel 24B for the side box 24 and the back plate panel 20A may serve as the cabinet 32 for the personal computer body 14 together with or without the top plate panel 16A because they can arrange and receive various electronic devices of relatively smaller thickness for the personal computer function units 30. This also allows the space to be saved by arranging the personal computer function units 30 to the configuration of the desk 10 while the original function of the desk for containing the stationery or the likes and the appearance of the desk are maintained.

In this embodiment, only one of the desk forming members 28 may be used for the cabinet 32 entirely or partially containing the personal computer function units 30. Alternatively, the top plate panel 16A may contain a part or parts of the personal computer function units 30 while the desk forming member or members 28 such as the leg panel 18A, the side plate panel 24B or the back plate panel 20A may contain the rest of the personal computer function units 30, which means that the personal computer function units 30 are contained in a scattered manner.

The desk forming member or members 28 such as the leg panel 18A other than the top plate panel 16A, which serves as the cabinet for the personal computer body 14 may preferably comprise the forming member stationary body 28A and the forming member movable body 28B such as the cover in the same manner as the top plate panel 16A serving as the cabinet for the personal computer body 14 as shown in the embodiments of FIGS. 7 and 9 though 11. Although this causes the cavity or interior of the desk forming members 28 serving as the cabinet for the personal computer function units 30 to be hidden or closed, the personal computer function units 30 may be protected while they may be adapted to be easily maintenained, checked and/or repaired. The detailed arrangement of the assembly means 80 as well as the forming member stationary body 28A and the forming member movable body 28B may be identical to that of FIGS. 9 through 11.

It will be understood by those skilled in the art that since the desk forming member 28 not serving as the cabinet for containing the personal computer function units 30 is not required to have any cavity or inner hollow, it may be solid and that they may have such a configuration as the personal computer function units 30 cannot be contained. Thus, the cross section of the leg panel 18A may be in the form of circle, regular square or triangle, but not in the form of elongated rectangle and the desk forming members 28 such as the back plate panel 20 and the side box 24 may be formed of solid plate.

It will be understood that the form of the desk body 12 is not limited to that of the aforementioned embodiments and that various forms may be employed. For instance, the desk body 12 may have no shallow drawer 26. In this case, the top plate panel 16A serving as the cabinet for the personal computer body 14 might more preferably have the lower cover 74 as shown in FIG. 7 to protect the personal computer function units 30 within the top plate panel 16A.

Although, in the illustrated embodiments, the side box 24 is provided integrally with the other desk forming members 28, it may be in the form of separate type having casters provided thereon, which allows the side box 24 to be withdrawn out of the top plate panel 16A and to serve as a side table.

Also, although, in the illustrated embodiments, the personal computer function units 30 such as the FD drive 48, the CD-ROM drive 50 and so on are housed within the upper panel portion 24A of the side box 24 as shown in FIGS. 1 and 12, they may be housed within the desk forming member or members 28 other than the side box 24. In this case, the upper panel portion 24A of the side box 24 may be in the form of solid panel or may be replaced by a shallow drawer. Otherwise, the shallow drawer 26 may be provided along the entire width of the top plate panel 16A including the top plate panel portion corresponding to the side box or the side box 24 itself may be omitted. As shown in FIG. 1, adjusters 94 may be provided for adjusting the height of the desk body 12 and the leg panel 18A may be provided with a leg cover 96.

With the side box 24 integrally with the top plate panel 16A as shown in FIG. 1, the personal computer function units 30 may be preferably housed within the cavity portion of the top plate panel 16A corresponding to the shallow drawer 26 because if they are housed within the cavity portion of the top plate panel 16A corresponding to the side box 24, the personal computer function units 30 cannot be checked from the under face of the top plate panel 16A unless the latter is provided so as to be able to be opened or closed as shown in the embodiments of FIGS. 11 and 12. Also, the lower cover 74 may be preferably provided at the position other than where the side box 24 is positioned.

It should be noted that the desk forming member or members 28 containing the personal computer function units 30 may be commercially available on the market. This allows the desk forming member or members 28 such as the top plate panel 16A containing the personal computer function units 30 to be replaced by the one containing the personal computer function units 30 having the higher grade so that there can be provided the personal computer making its grade higher. Furthermore, the conventional desk 10 can be economically modified as the personal computer housed desk 10 by replacing the top plate panel 16A of the conventional desk 10 for the one containing the personal computer function units 30.

It should be also noted that the desk forming member or members 28 having the cavity or inner hollow 28*a* in which the personal computer function units 30 can be entirely or partially contained and/or the support member which may include the holding member 68 to which the personal computer function units 30 can be supported or held may be commercially available on the market as the empty cabinet 32 for the personal computer body 14. This can be advantageously utilized when a user want to optionally assemble various electronic devices into a personal computer body 14.

It should be noted that the term "personal computer function unit" includes a concept of the so-called word processor function unit as well as the original personal computer function unit. Thus, it will be understood that the desk of the invention includes the word processor body housed desk.

Of late, the computer associated techniques have been rapidly developed. For example, a thinner liquid crystal display with higher quality is expected to be more developed, an input unit is considered to be provided which may be operated or instructed by a person's voice and a printer as an output unit will be equipped only when needed in many cases. Thus, it should be noted that the space in which the personal computer body 14 is contained will be more important and therefore saving the space for containing the personal computer body 14 is more and more required. In view of such a consideration, the invention is aimed at saving such a space for the personal computer body and, in the illustrated embodiments, only the personal computer body 14 having the personal computer function units 30 may be contained in the desk body 12 while the former is adapted to the latter, but the peripheral equipments may be housed within the cavity or inner hollows of the desk forming members 28 unless the original functions of the desk are damaged.

For instance, a thinner liquid crystal display may be provided within the back plate panel 20A so that it may be moved through a lifter whereby the display can appear or disappear. This might be able to save the space in which the display is housed without damaging the appearance and function of the back plate panel 20A.

Although some preferred embodiments of the invention have been illustrated and described with reference to the accompanying drawings, it will be understood by those skilled in the art that they are by way of examples, and that various changes and modifications may be made without departing from the spirit and scope of the invention, which is defined only to the appended claims.

What is claimed is:

1. In a desk constructed of desk forming members including a panel providing an upper desk work surface and a panel supporting frame, said frame being structurally connected to said panel and supporting said panel at a selected desk working height above a floor, and at least one of said desk forming members including a cavity, the improvement comprising a computer function unit mounted within said at least one cavity without the use of a separate structural computer enclosure for the function unit, said computer function unit being supported in said cavity without significantly affecting conventional desk functions or appearance as compared with an identical desk that does not contain such a computer function unit, said computer function unit including at least a central processing unit and a random access memory to perform an arithmetic and logic operation.

2. A desk for housing a personal computer comprising a desk body including a plurality of desk forming members and a personal computer body comprising personal computer function units including at least a central processing unit and a random access memory to perform an arithmetic and logic operation, said desk forming members including a top plate panel providing an upper desk work surface and a supporting frame, said frame being structurally connected to said panel and supporting said panel at a selected desk working height above a floor, and at least one of said desk forming members providing a cabinet including a cavity containing said personal computer function units whereby said at least one of said desk forming members serves as a cabinet for containing said personal computer body without the use of a separate structural computer enclosure for the personal computer body, said personal computer body being supported in said cavity without significantly affecting conventional desk functions or appearance as compared with an identical desk that does not contain such a personal computer body.

3. A desk as forth in claim 2 and wherein said desk forming member containing at least one of said personal computer function units is at least one of said top plate panel, a leg panel, a side plate panel for a side box and a back plate panel whereby said desk forming member containing said personal computer function units serves as said personal computer body.

4. A desk as forth in claim 3 and wherein said desk forming member containing said personal computer function units is said top plate panel and a shallow drawer is provided under said top plate panel.

5. A desk as set forth in either of claims 2 through 4 and wherein at least one of external memory drives including a read only memory using a compact disk and a flexible disk and a power switch is provided in at least one of said desk forming members so that they are able to be operated on a front face of said desk body.

6. A desk as set forth in either of claims 2 through 4 and wherein said desk body has a connection to be connected to at least one of an external hard disk and external memory drives.

7. A desk as set forth in either of claims 2 through 4 and wherein at least one of external memory drives including a read only memory using a compact disk and a flexible disk and a power switch is provided in at least one of said desk forming members so that they are able to be operated on a front face of said desk body and also wherein said desk body has a connection to be connected to at least one of an external hard disk and external memory drives.

8. A desk as set forth in either of claims 2 through 4 and wherein at least one of said desk forming members containing at least one of said personal computer function units is assembled with the rest of said desk forming members so that it can be disassembled.

9. A desk as set forth in either of claims 2 through 4 and wherein at least one of said desk forming members containing at least one of said personal computer function units has means to have access to at least one of said personal computer function units contained within said desk forming member.

10. A desk as set forth in either of claims 2 through 4 and further comprising means to protect said at least one of said personal computer function units from external atmosphere.

11. A desk as set forth in claim 9 and wherein said means to have access to at least one of said personal computer function units contained within said desk forming member is in the form of being able to open said desk forming member whereby said at least one of said computer function units is exposed.

12. A desk as set forth in claim 9 and wherein said means to have access to at least one of said personal computer function units contained within said desk forming member is in the form of being able to disassemble said desk forming member whereby said at least one of said computer function units is exposed.

13. A desk as set forth in claim 9 and wherein said means to have access to at least one of said personal computer function units contained within said desk forming member is in the form of being able to remove said desk forming member out of said desk body whereby said at least one of said computer function units is exposed.

14. A desk as set forth in claim 10 and wherein means to protect said at least one of said personal computer function units from external atmosphere comprises a cover provided on said desk forming member so as to cover said at least one of said personal computer function units.

15. A desk as set forth in claim 14 and wherein said cover also serves as a holding member to hold said at least one of said personal computer function units.

16. A desk as set forth in claim 14 and wherein said at least one of said desk forming members containing said at least one of said personal computer function units is said top plate panel and said cover is provided between said top plate panel and a shallow drawer so as to close said cavity of said top plate panel.

17. A desk for housing a personal computer comprising a desk body including a plurality of desk forming members and a personal computer body comprising personal computer function units including at least a central processing unit and a random access memory to perform an arithmetic and logic operation, said desk forming members including a top panel providing an upper desk work surface and a plurality of side panels forming a frame supporting said top panel, said panels being structurally connected and supporting said top panel, and at least one of said desk forming members providing a cabinet including a cavity containing said personal computer function units whereby said at least one of said desk forming members serves as a cabinet for containing said personal computer body without the use of a separate structural computer enclosure for the personal computer body, said personal computer body being supported in said cavity without significantly affecting conventional desk functions or appearance as compared with an identical desk that does not contain such a personal computer body.

18. A desk forming member adapted to be structurally connected to form a desk together with other desk forming members and to integrally house a personal computer body comprising personal computer function units including at least a central processing unit and a random access memory to perform an arithmetic and logic operation, at least one of said desk forming members providing a cabinet containing at least one of said personal computer function units whereby said forming member serves as a cabinet for containing said personal computer body without the use of a separate structural computer enclosure for the personal computer body, said personal computer body being supported in said cavity without significantly affecting conventional desk functions or appearance as compared with an identical desk that does not contain such a personal computer body.

19. A personal computer housed desk forming member as forth in claim 18 and wherein said personal computer housed desk forming member is at least one of a top plate panel, a leg panel, a side plate panel for a side box and a back plate panel whereby said desk forming member containing said at least one of said personal computer function units is said personal computer body.

20. A personal computer housed desk forming member as set forth in either of claims 18 and 19 and wherein at least one of said desk forming members containing at least one of said personal computer function units has means to be removably assembled with other desk forming members so as to form said personal computer housed desk.

21. A personal computer housed desk forming member as set forth in either of claims 18 and 19 and wherein at least one of said desk forming members containing at least one of said personal computer function units has means to have access to at least one of said personal computer function units contained within said desk forming member.

22. A personal computer housed desk forming member as set forth in either of claims 18 and 19 and further comprising means to protect said at least one of said personal computer function units from external atmosphere.

23. A personal computer housed desk forming member as set forth in claim 21 and wherein said means to have access to at least one of said personal computer function units contained within said desk forming member is in the form of being able to open said desk forming member whereby said at least one of said computer function units is exposed.

24. A personal computer housed desk forming member as set forth in claim 21 and wherein said means to have access to at least one of said personal computer function units contained within said desk forming member is in the form of being able to disassemble said desk forming member whereby said at least one of said personal computer function units is exposed.

25. A personal computer housed desk forming member as set forth in claim 21 and wherein said means to have access to at least one of said personal computer function units contained within said desk forming member is in the form of being able to remove said desk forming member out of said desk body whereby said at least one of said computer function units is exposed.

26. A personal computer housed desk forming member as set forth in claim 25 and wherein means to protect said at least one of said personal computer function units from external atmosphere comprises a cover provided on said desk forming member so as to cover said at least one of said personal computer function units.

27. A personal computer housed desk forming member as set forth in claim 26 and wherein said cover also serves as a holding member to hold said at least one of said personal computer function units.

* * * * *